US006145722A

United States Patent [19]

Behrens et al.

[11] Patent Number: 6,145,722

[45] **Date of Patent: *Nov. 14, 2000**

[54] TAPE DISPENSER

[75] Inventors: Dietmar Behrens, Dusseldorf; Hilmar Schroeter, Leichlingen, both of Germany

[73] Assignee: 3M Innovative Properties Company, St. Paul, Minn.

[ * ] Notice: Under 35 U.S.C. 154(b), the term of this patent shall be extended for 1133 days.

[21] Appl. No.: 08/518,856

[22] Filed: Aug. 24, 1995

Related U.S. Application Data

[63] Continuation of application No. 08/183,736, Jan. 19, 1994, abandoned.

[30] Foreign Application Priority Data

Jan. 27, 1993 [DE] Germany ..... 43 02 107

[51] Int. Cl.[7] ..... B65F 3/02; B65H 35/10; B65D 85/67

[52] U.S. Cl. ..... 225/42; 225/39; 225/41; 225/44; 225/47; 225/77; 206/403; 206/409; 206/411

[58] Field of Search ..... 206/411, 403, 206/409; 225/39, 47, 56, 57, 58, 42, 41, 25, 77, 48, 49, 80, 59, 66, 44; 221/70, 71; 242/599, 599.1, 601; 24/698.1; 224/162; 248/220.21, 225.21, 221.11

[56] References Cited

U.S. PATENT DOCUMENTS

| | | | |
|---|---|---|---|
| 2,640,656 | 6/1953 | Donkin | 225/77 |
| 2,681,186 | 6/1954 | Slawik | 242/55.5 |
| 2,790,609 | 4/1957 | Hawthorne et al. | 206/403 X |
| 2,809,761 | 10/1957 | Delbert | 156/527 |
| 3,127,078 | 3/1964 | Dubnick | 225/66 X |
| 3,301,518 | 1/1967 | Yetter et al. | 248/221.11 X |
| 3,322,262 | 5/1967 | Puente | 206/403 X |
| 3,362,578 | 1/1968 | Spencer | 221/70 |
| 3,796,341 | 3/1974 | Berman | 220/4 B |
| 3,815,801 | 6/1974 | Perrin | 225/48 X |
| 3,869,094 | 3/1975 | Weick et al. | 156/577 X |
| 3,972,459 | 8/1976 | Cooper | 225/47 |
| 4,106,617 | 8/1978 | Boone | 248/225.21 X |
| 4,676,370 | 6/1987 | Rudick | 206/404 X |
| 4,928,864 | 5/1990 | Walker et al. | 225/66 X |
| 5,058,792 | 10/1991 | Morand | 226/47 X |
| 5,065,925 | 11/1991 | Ridenour | 225/47 X |
| 5,083,717 | 1/1992 | Samuelson et al. | 242/55.53 |

FOREIGN PATENT DOCUMENTS

| | | | |
|---|---|---|---|
| 1 761 405 | 5/1972 | Germany . | |
| 2708.081 | 8/1978 | Germany | 24/698.1 |
| 85 10 538 U | 7/1985 | Germany . | |
| 87 00 892 U | 4/1987 | Germany . | |
| 87 03 412 U | 9/1987 | Germany . | |
| 3731723C2 | 4/1988 | Germany . | |
| 87 00 863 U | 7/1988 | Germany . | |
| 3800391A1 | 12/1988 | Germany . | |
| 88 15 665 U | 5/1989 | Germany . | |
| 88 04 005 U | 8/1989 | Germany . | |
| 89 11 613 U | 12/1989 | Germany . | |
| 90 16 485 U | 4/1991 | Germany . | |
| 364 714 | 9/1962 | Switzerland | 225/62 |
| 1083587 | 9/1967 | United Kingdom . | |

*Primary Examiner*—Curtis Mayes
*Attorney, Agent, or Firm*—David B. Patchett

[57] ABSTRACT

The adhesive tape dispenser comprises a housing being provided with a unilaterally open housing body for receiving an adhesive roll of tape. The aperture of the housing body is closeable by a cover. The cover is secured to the housing body by twisting it relative to the housing body. This is effected, e.g., by means of a bayonet closure or a threaded closure.

16 Claims, 5 Drawing Sheets

II
IV
IV
10
58
30
26
28
20
36
12
34
58
62
58
20
18
19
16

10
24
14
26
12
16
36
22
18
30
28

TAPE DISPENSER

This is a continuation of application Ser. No. 08/183,736 filed Jan. 19, 1994, now abandoned.

The invention relates to a tape dispenser, particularly an adhesive tape dispenser out of which adhesive tape wound into a roll is pulled out, whereby individual sections of the adhesive tape may be cut off.

Such adhesive tape dispensers are known in different configurations, these adhesive tape dispensers being used for various purposes in households and offices. Basically, the known adhesive tape dispensers can be divided into two groups, namely adhesive tape dispensers with a housing receiving the adhesive tape roll, which housing is completely closed except for a passage for the adhesive tape, and adhesive tape dispensers without a housing where the adhesive tape roll is uncovered. Examples for this last mentioned group can be found in DE 87 00 863 U1, DE 87 00 892 U1, DE 38 00 391 A1, DE 88 04 005 U1, DE 89 11 613 U1, and U.S. Pat. No. 5,083,717. A certain problem with tape dispensers with an open housing or an uncovered adhesive tape roll is that the adhesive tape roll gets soiled, which, on the one hand, is caused by the electrostatic charging of the tape material, and, on the other hand, by the fact that the front sides of the adhesive tape roll are provided with adhesive material to a small extent, since the entire one side is coated with adhesive material, which thus adheres to the longitudinal edges of the adhesive tape, if only to a small extent.

Examples for the above mentioned second group of tape dispensers with a substantially closed housing receiving the adhesive tape roll can be found in DE 85 10 538 U1, DE 87 03 412 U1, DE 37 31 723 C2, and DE 88 15 665 U1. In this group, the opening and closing of the housing presents a certain problem, since the housings are partially provided with screw connections, or the housing covers are held in a clamping joint at the remaining housing body, and therefore, it is difficult to detach them or place them on the body in case of tilting.

DISCLOSURE OF THE INVENTION

It is the object of the invention to provide a tape dispenser, particularly an adhesive tape dispenser for dispensing tape strips, which, on the one hand, protects the tape roll, and, on the other hand, permits easy replacement of the tape rolls.

In order to solve this object, the invention suggests a tape dispenser, particularly an adhesive tape dispenser comprising

- a housing for receiving a roll of tape, the housing comprising a housing body with an aperture being closeable by a cover for inserting and/or removing a roll of tape into or out of the housing which is provided with a passage for the tape, and
- a hub arranged,in the housing body for rotatably supporting the roll of tape,
- the cover including a stud, and
- the stud and the hub comprising cooperating means for securing the cover to the housing body by twisting the cover.

The tape dispenser according to the invention comprises the housing which is closed except for the passage for the tape, in which housing the roll of tape or tape roll is rotatably accommodated. The housing consists of a housing body in whose housing section facing the peripheral surface of the roll of tape the passage for leading the tape from the roll of tape to the outside is formed. Further, the housing body is provided with the aperture which can be covered by the cover. In the housing body, the hub for rotatably supporting the roll of tape is arranged, the end of which hub, which points at the aperture, preferably has an open or hollow configuration. This means that in case of an open housing body, the roll of tape can be pushed onto the hub in the axial direction thereof. The cover comprises a flat cover portion covering the aperture of the housing body, at the inner surface of which cover portion a stud is arranged which is concentric with the hub. If the housing body is closed, the stud preferably is in the open end of the hub of the housing body. The cover is held in abutting contact with the housing body by twisting it relative to the housing body when being in abutting contact with the housing body and its stud being in the hub. At the stud and the hub, cooperating means are provided by means of which the cover is securely held to the housing body when being twisted relative to the housing body. These cooperating means are preferably provided at the outer surface of the stud and the inner surface of the hub. These means may be, e.g., an outer thread and an inner thread or preferably a bayonet closure.

It is also possible to provide for the stud at the hub of the housing body and for a reception of this stud at the inside of the cover. This means that, in any case, a plug/twist connection is provided between the cover and the hub to realize, by twisting the cover relative to the housing body, that the cover is secured to the housing body.

In the tape dispenser according to the invention, the housing body is closed by the cover by initially placing the cover on the housing body and subsequently twisting it over a preferably quite small angular range relative to the housing body. The means for securing the cover to the housing body get into mutual engagement in case of twisting and retain the cover at the housing body. Preferably, the cover covers the aperture extending across one side of the housing body, which aperture is opposite to one of the two front sides of the roll of tape. Preferably, the housing body is cylindrical in shape, i.e. it is formed corresponding to a more or less flat can adapted to the width of the tape material to be used, which can be closed by means of the cover. In the peripheral surface of this can, the passage is configured through which the end of the tape material pulled from the roll of tape is led to the outside. Outside the housing, a generally fine-toothed fixed knife is arranged over which the adhesive tape is drawn to be able to cut off the foremost end of the adhesive tape. It is aesthetically appealing when this knife is arranged at the upstanding tip of a triangular housing section linked to the housing body. This housing section comprises a front wall extending vertically to the supporting face of the tape dispenser, and a bottom wall extending vertically to the front wall, the cylindrical housing body being formed to the inclined wall of the housing section such that the bottom wall of the housing section extends substantially tangentially to the peripheral wall of the housing body. The passage in the peripheral wall of the housing body then substantially faces the tip of the housing section carrying the knife.

As already explained above, the means for securing the cover to the housing may be a bayonet closure. In this case, the stud of the cover carries at least one radially projecting projection (bayonet projection) which is movable behind a radial inner projection of the hub of the housing body by twisting the cover. Preferably, the inner projection of the hub of the housing body is provided with an inclined surface at its side facing away from the cover so that the cover is moved against the housing body when being twisted relative to the housing body. Moreover, the side of the inner projection facing away from the cover is preferably provided with a snap-in recess for receiving at least one outer projection at the stud of the cover. Thus, the cover and the housing body, in their locking position, are connected in a snap-in engagement, so that an unintended removal of the cover from the housing body is prevented.

To limit the twisting movement of the cover relative to the housing body, a limiting stop is provided at the inner projection, against which stop the outer projection of the stud of the cover, which engages behind the inner projection, abuts.

Preferably, the bayonet closure is provided with four bayonet projections at the stud of the cover, these four projections, respectively, being spaced by 90° relative to each other. In contrast thereto, only two inner projections are provided at the hub of the housing body, which are arranged in a diametrically opposed relationship. When placing the cover onto the housing, a twisting movement of the cover by 90° at maximum is sufficient to secure the cover at the housing. This facilitates manipulation of the tape dispenser.

Further, it is advantageous for manipulating the tape dispenser if the cover comprises a central recess in its cover portion. Preferably, this recess is defined by a cylindrical stub or the like projecting into the housing body, which forms the stud that can be plugged into the hub of the housing body or carries this stud. By forming the inner recess, an improved manipulation of the cover when being twisted relative to the housing body is provided by gripping with the thumb of the hand into the recess and subsequently, the cover may be gripped and twisted by the thumb and the index finger which abuts at the outer edge of the cover. Furthermore, for improving gripping of the cover, it can be provided at its peripheral surface with a structuring, e.g. it may be knurled or, generally speaking, be provided with a plurality of projections. Preferably, the structuring is selected so as to result in an appealing aesthetic appearance of the tape dispenser.

Preferably, the hub of the tape dispenser on which the roll of tape is supported has a two-part form. The one hub half is arranged integrally with the housing body and the other hub half integrally at the cover portion of the cover. Both hub halves are in alignment with each other, the hub half formed to the cover portion supporting the stud which can be plugged into the end of the hub half of the housing body facing the cover. Preferably, both hub halves are hollow along their entire respective axial extension. Thus, an axial passage aperture extends through the housing receiving the roll of tape. Thus, in case of a cylindrical housing, an annular space for receiving the roll of tape is created. The radial extension of this annular space is not impaired by the securing mechanism between the housing body and the cover, therefore, the housing may be small. If, moreover, provision is made for the cover portion to abut the aperture edge defining the aperture of the housing body only from the outside without a projecting edge or collar connected with the cover portion protruding into the housing body, the housing may be formed relatively small also in this respect. Both above explained measures permit to select the size of the housing corresponding to the maximum thickness of the roll of tape to be received. Therefore, the tape dispenser provided with such a housing does not have a bulky appearance, and thus, it has an optically appealing design.

Preferably, the hub of the housing body supporting the roll of tape has a concave outer peripheral surface. The concave outer surface is preferably obtained by two conic sections which widen from the center of the hub to the two ends. This conic configuration and the concave configuration of the hub, respectively, provide for a centering of the roll of tape when tape is drawn off, therefore, rolls of tape having a smaller width than the axial length of the hub can be used as well. Preferably, the concave configuration of the hub is used with the above described configuration of the tape dispenser wherein the hub has a two-part form and the cover portion and the housing body, respectively, have a hub half which, in this case, is tapered towards its free end.

Further, in an advantageous further development of the invention, spacer means are provided at the surfaces of cover and housing body opposing the front sides of the roll of tape. By means of these spacer means, the roll of tape, or, more precisely, the core onto which the tape is wound, is held in a minimum distance to the respective inner surface of cover and/or housing body. Thereby, spoiling of these surfaces by particles which possibly adhere to the front ends of the roll of tape is prevented. This is especially advantageous when the cover and/or the housing body are made of transparent material which permits easy determination of how much unused adhesive tape is left in the housing.

To improve the rotational guidance of the cover at the housing, the cover portion is preferably provided with an annular groove of low depth opening towards the aperture edge of the housing body, in which groove the aperture edge of the housing body is inserted in the closed state thereof. Not least because of this, also the wall of the housing body in its section encompassing the roll of tape from the outside is stabilized when the housing is closed. This stabilization is particularly advantageous with respect to material saving, for, in this respect, a housing with a lower wall thickness can be used at least in the section thereof encompassing the roll of tape. A stabilization is particularly necessary in the region of the passage of the housing body, because this passage extends across the total width of the housing, i.e. along the total extension of the housing in the direction of width of the roll of tape. Thereby, it is possible to lead the end drawn off the roll of tape through the passage at the same time when inserting the roll of tape into the housing body.

To improve the stability of the tape dispenser when drawing off tape, a holding means for the housing of the tape dispenser is suggested, which comprises a mounting member which can be fixed at a surface and at least one protruding hook-shaped holding element arranged at this mounting member for encompassing a holding projection formed at the housing of the tape dispenser. With its holding projection, the housing of the tape dispenser is moved towards the hook-shaped holding element, pointing thereat, until the hook-shaped holding element of the holding means encompasses the holding projection. Preferably, either the hook-shaped holding element or the holding projection is provided with a wedge surface for wedging the holding element and the holding projection. Preferably, the holding element and the holding projection are oriented relative to each other such that a force acts upon the housing when drawing tape off the roll of tape which force urges the holding element towards the holding projection. Thus, the connection between the tape dispenser housing and the holding means cannot be dissolved even when tape is drawn off.

BRIEF DESCRIPTION OF DRAWING

Hereinafter, an embodiment of the invention is explained in more detail with respect to the drawings, in which.

DETAILED DESCRIPTION

Figure 1:
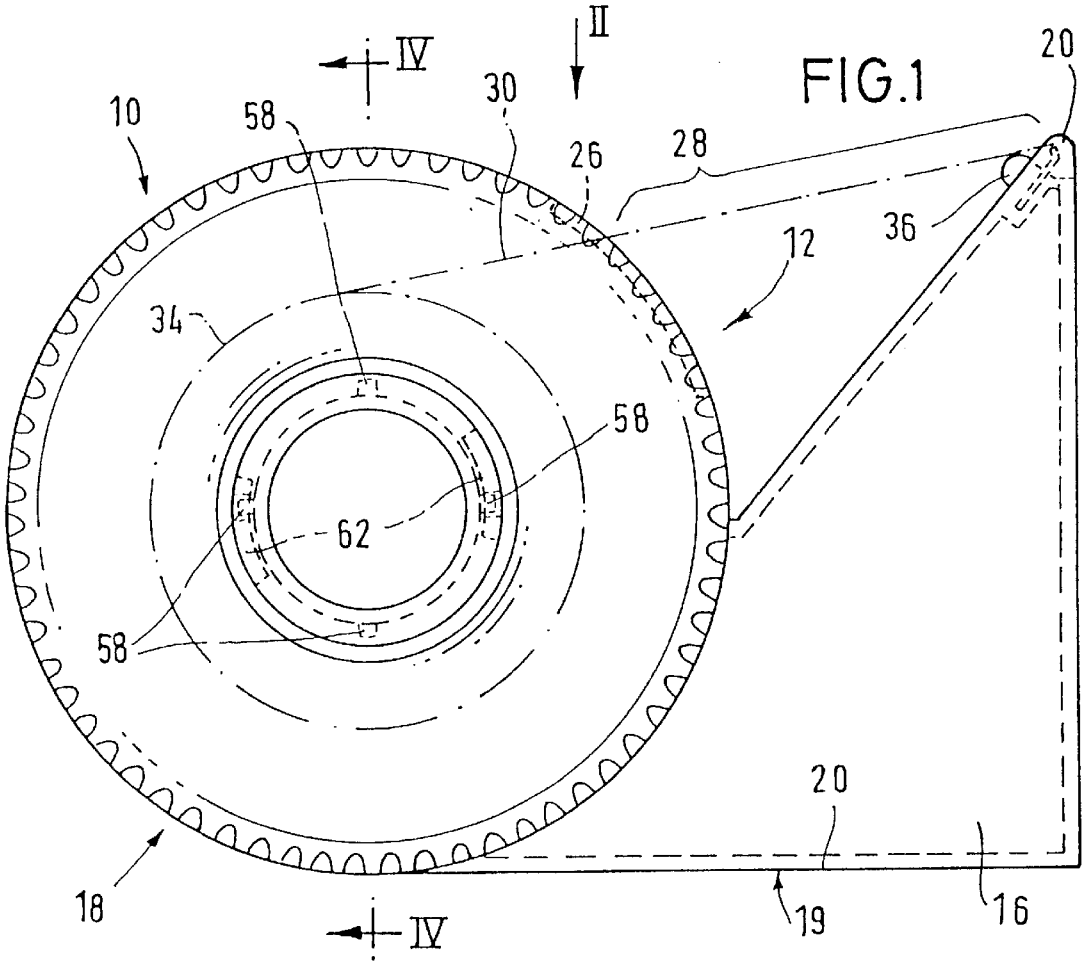
FIG. 1 is a side view of an adhesive tape dispenser.
Figure 2:
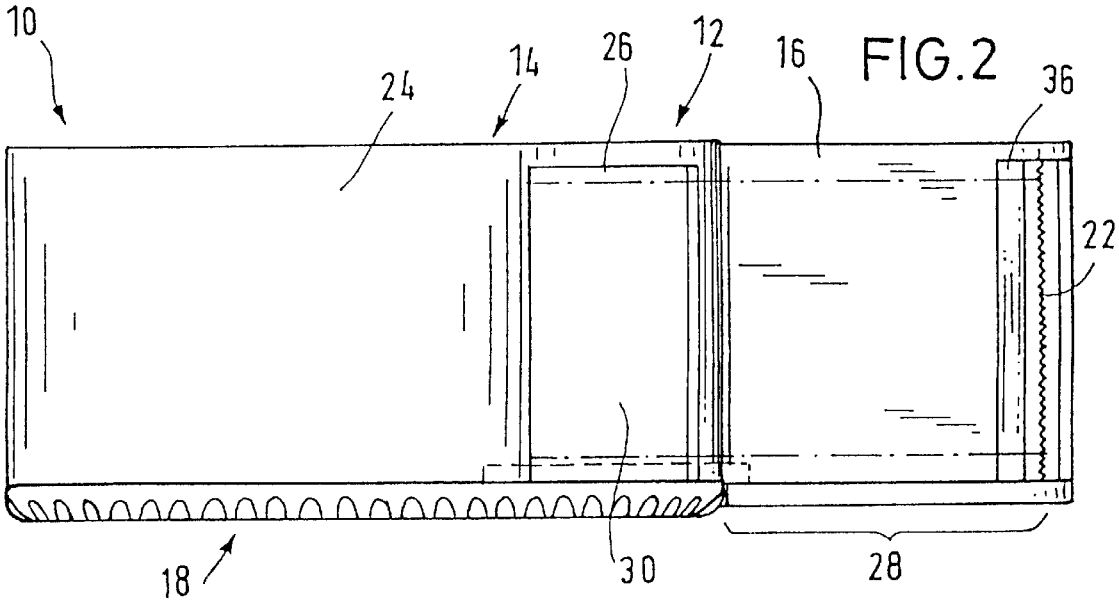
FIG. 2 is a plan view of the adhesive tape dispenser according to FIG. 1 in the direction of arrow II.

In FIGS. 1 and 2, a side view and a plan view of a tape dispenser 10 are shown. The adhesive tape dispenser 10 comprises a plastic housing 12 comprising a can-like cylindrical housing body 14 being open at one front side and being integrally connected with a triangular housing section 16. The open end of the housing body 14 can be closed by a cover 18 (see also FIG. 3). The axial length of the housing body 14 equals the width of the triangular housing section 16. Viewed from the side, the housing section 16 is substantially similar to a rectangular triangle the one cathetus of which extends tangentially to the housing body 14 and changes into the peripheral line of the housing body 14. This cathetus defines the bottom wall 19 of the triangular housing section 16 onto which the adhesive tape dispenser is supported. The height of the triangular housing section 16 is slightly higher than the diameter of the housing body 14, so that the uppermost edge 20 of the housing section 16 slightly protrudes beyond the uppermost point of the housing body 14. At the edge 20 of the housing section 16, it carries an uncovered toothed knife 22. In the peripheral wall 24 of the housing body 14, a tape passage 26 is formed in the region of the peripheral wall facing the edge 20 of the housing section 16. This tape passage 26 substantially extends along the entire axial length of the housing body and in the peripheral direction of the peripheral wall 24. Through this tape passage 26 extends the free end 28 of an adhesive tape 30, which is led out of the housing body 14 and is wound on a core 32 to form a roll of tape or a tape roll 34. The roll of tape 34 along with its core 32 is accommodated in the housing body 14. Just below the knife 22, a substantially semicircular projection 36 is arranged at the inclined wall of the housing section 16 facing the housing body 14 (in side view, defined by the hypotenuse of the housing section configured in the manner of a rectangular triangle). As indicated in FIG. 1, the free end 28 of the adhesive tape 30 adheres to this projection 36. Thus, the free end 28 has its graphically illustrated course in its section between the roll of tape 34 and the knife 22.

Figure 3:
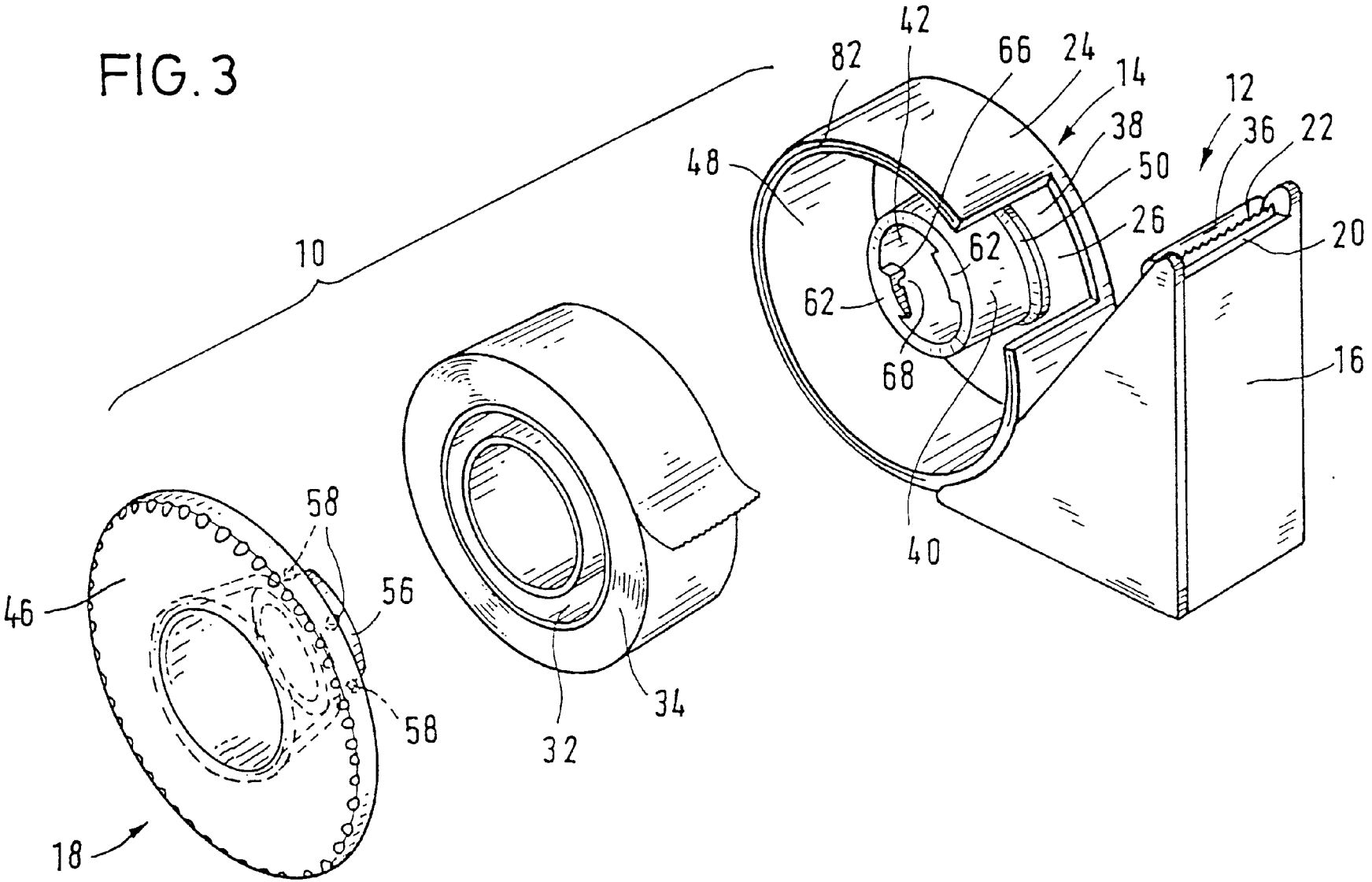
FIG. 3 is a perspective view of the adhesive tape dispenser according to FIG. 1 with a roll of tape and the cover being removed.
Figure 4:
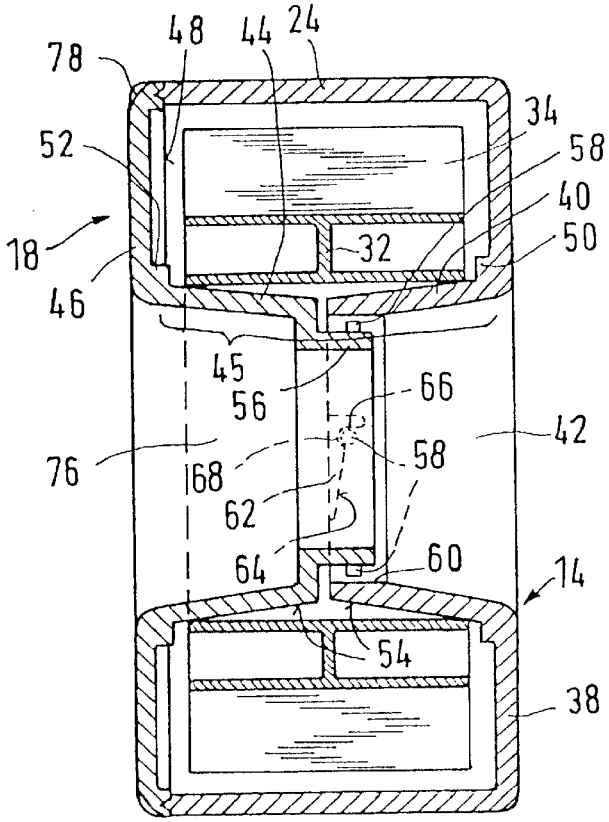
FIG. 4 is a vertical section along the plane IV—IV of FIG. 1.

Referring to FIGS. 3 and 4, the internal structure of the housing body 14 along with the cover 18 receiving the roll of tape 34 is to be described hereinafter. The housing body 14 comprises a slightly tapered half hub 40 protruding from its closed front side wall 38 to the interior and being integrally formed thereto. The half hub 40 is tapered towards its free end which protrudes into the housing body 14. As can be seen in FIG. 4, the front side wall 38 of the housing body 14 is not completely closed, but comprises a through opening 42 which is formed by the half hub 40. The second half hub 44, which, according to FIG. 4, together with the half hub 40 arranged at the housing body 14, forms the hub 45 for rotatably supporting core 32 and roll of tape 34, is formed to cover 18 and is tapered towards its free end, similar to half hub 40. The half hub 44 is connected with a cover portion 46 of cover 18; the cover portion 46 is the section of cover 18 which functions to close a tape roll aperture 48 defined by the missing front side wall of the housing body 14. At the transition points of the half hubs 40 and 44 to the front side wall 38 of the housing body 14 and the cover portion 46 of cover 18, respectively, annular projections 50,52 are formed, which annular surfaces facing each other are spaced to the front side wall 38 and the cover portion 46, respectively. As indicated in FIG. 4, the roll of tape 34 is thus held in a minimum distance to the end wall 38 and the cover 18, respectively, when the core 32 abuts the annular surfaces of the annular projections 50,52. Owing to the conic configuration of the two half hubs 40,44, the peripheral or running surface of the hub 45 consisting of the half hubs 40 and 44 has a concave shape. This produces a centering effect onto the core 32 and the roll of tape 34 when drawing adhesive tape off the roll of tape 34.

The free end of the half hub 44 of the cover 14, which protrudes into the housing body 14, carries a stud 56 having the configuration of a continuous collar being concentric with the hub 45 or the half hubs 40,44. The annular stud 56 has a smaller diameter than the free end of the half hub 40 of the housing body 14, therefore, it is inserted into this half hub 40, when the housing body 14 is closed by the cover 18 (see FIG. 4). At its outer peripheral surface 57, the annular stud 56 carries four circumferentially equally spaced locking projections 58 which oppose the inner surface 60 of the half hub 40 when the housing body 14 is closed.

At the inner surface 60 of the half hub 40, two diametrically opposing projections 62 are arranged which are formed to the half hub 40 and are even with the front side end thereof. The projections 62 extend over 30° to 50°, preferably over 40° in the circumferential direction at the inner surface 60 of the half hub 40. The rear edge of the projections 62 facing away from the cover 18 respectively comprises an inclined surface 64. Further, the projections 62 are provided with stops 66 extending in the axial direction of the half hub 40. A recess 68 is formed in the edge of each projection 62 facing away from the cover 18 between the stop 66 and the end of the inclined surface 64 facing this stop 66.

The four locking projections 58 of the annular stud 56 as well as the projections 62 at the inner surface 60 of the half hub 40 function together in the manner of a bayonet closure to secure the cover 18 to the housing body 14. The cover 18 is placed upon the aperture 48 of the housing body 14, its annular stud 56 with the locking projections 58 being inserted in the end of the half hub 40 of the housing body 14, which end faces the cover 18. The angular distance between two adjacent locking projections 58 of the annular stud 56 is smaller than the circumferential distance of the projections 62 of the half hub 40. Due to subsequent twisting of cover 18, two opposing locking projections 58 engage behind the projections 62 of the half hub 40, sliding along the inclined surfaces 64. Cover 18 is slightly axially moved towards the housing body 14. In case of continued twisting of cover 18, the two locking projections 58 which engage behind the projections 62 get into the recesses 68 into which they are inserted in a snap-like manner. Continued twisting of the cover 18 in the same rotational direction is prevented by the stops 66. Thus, the cover 18 is secured to the housing body 14 by being twisted relative thereto, and the housing 12 or its portion receiving the roll of tape 34 are closed.

Figure 5:
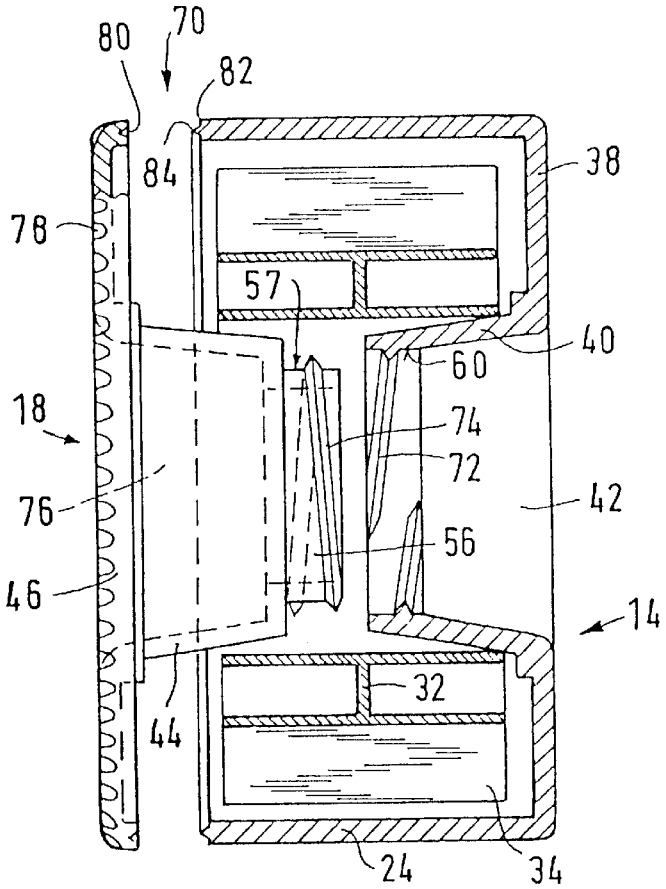
FIG. 5 is a vertical section similar to the one according to FIG. 4, but through a roll of tape-receiving housing of a tape dispenser according to another embodiment.

An alternative to the above described bayonet closure is illustrated in FIG. 5. Provided that the parts of the adhesive tape dispenser 70 shown in vertical section in FIG. 5 correspond to those of the adhesive tape dispenser 10 according to FIGS. 1 to 4, they are designated with like numerals. In contrast to adhesive tape dispenser 10, the adhesive tape dispenser 70 comprises a threaded closure. The inner surface 60 of the half hub 40 connected with the housing body 14 is provided with an inner thread 72 and the annular stud 56 supported by the half hub 44 of cover 18 is provided with an outer thread 74. In other respects, the structure of the adhesive tape dispenser 70 is the same as that of the adhesive tape dispenser 10 of FIGS. 1 to 4.

As shown in the Figures, in the cover portion 48 of cover 18, there is a through opening 76 similar to the through opening 42 in the front side wall 38 of the housing body 14, which through opening is formed by the half hub 44 protruding into the interior. On the whole, the unit formed by the housing body 14 and the cover 18 comprises a coaxial through opening 42,76. The recess in the cover portion 46 formed by the through opening 76 has the advantage that it is easier to manually grip and twist the cover 18 when the through opening 76 is entered by the thumb of the hand and the edge of the cover portion 46 gripped by the index finger. As indicated in the Figures, the peripheral edge is knurled to improve its grip. Moreover, the peripheral edge 78 is provided with an annular groove 80 facing the peripheral edge 82 of the housing body 14 defining the aperture 48. This aperture edge 82 supports a projection 84 which corresponds to the cross section of the annular groove 80, which projection is inserted into the annular groove 80 when the cover 18 is placed upon the aperture 48 and twisted. The above described configuration of cover and housing body can particularly be seen in FIG. 5. It, however, is not only realized with the adhesive tape dispenser 70, but also with the adhesive tape dispenser 10 of FIGS. 1 to 4. Finally, it should be mentioned that the cover 18 consists of a transparent plastic material to be able to check from the outside how much unused wound up adhesive tape 30 is left in the housing body 14.

Figure 6:
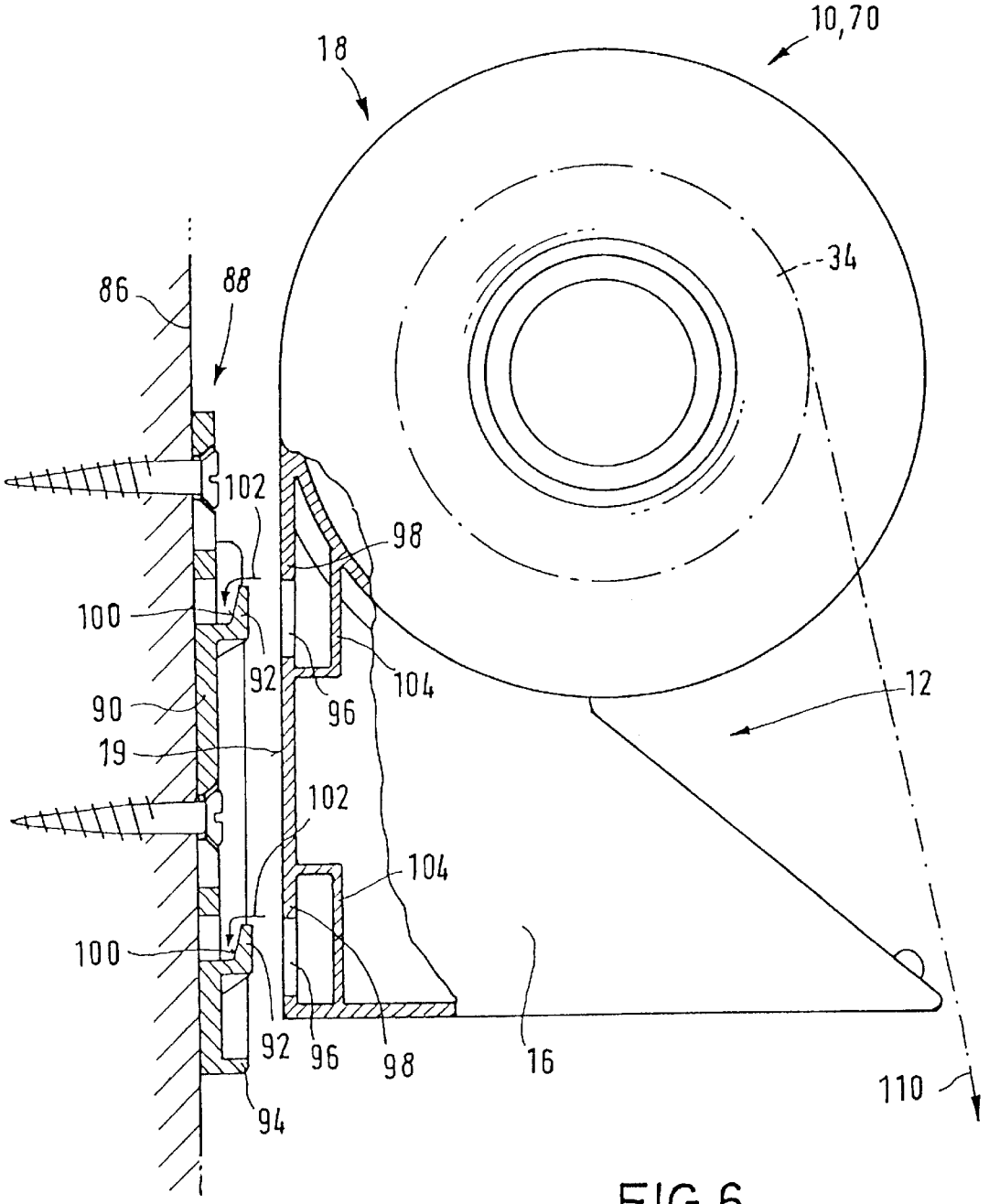
FIG. 6 shows the tape dispenser according to FIG. 1 with a tape dispenser retainer fastened to a wall by screws.
Figure 7:
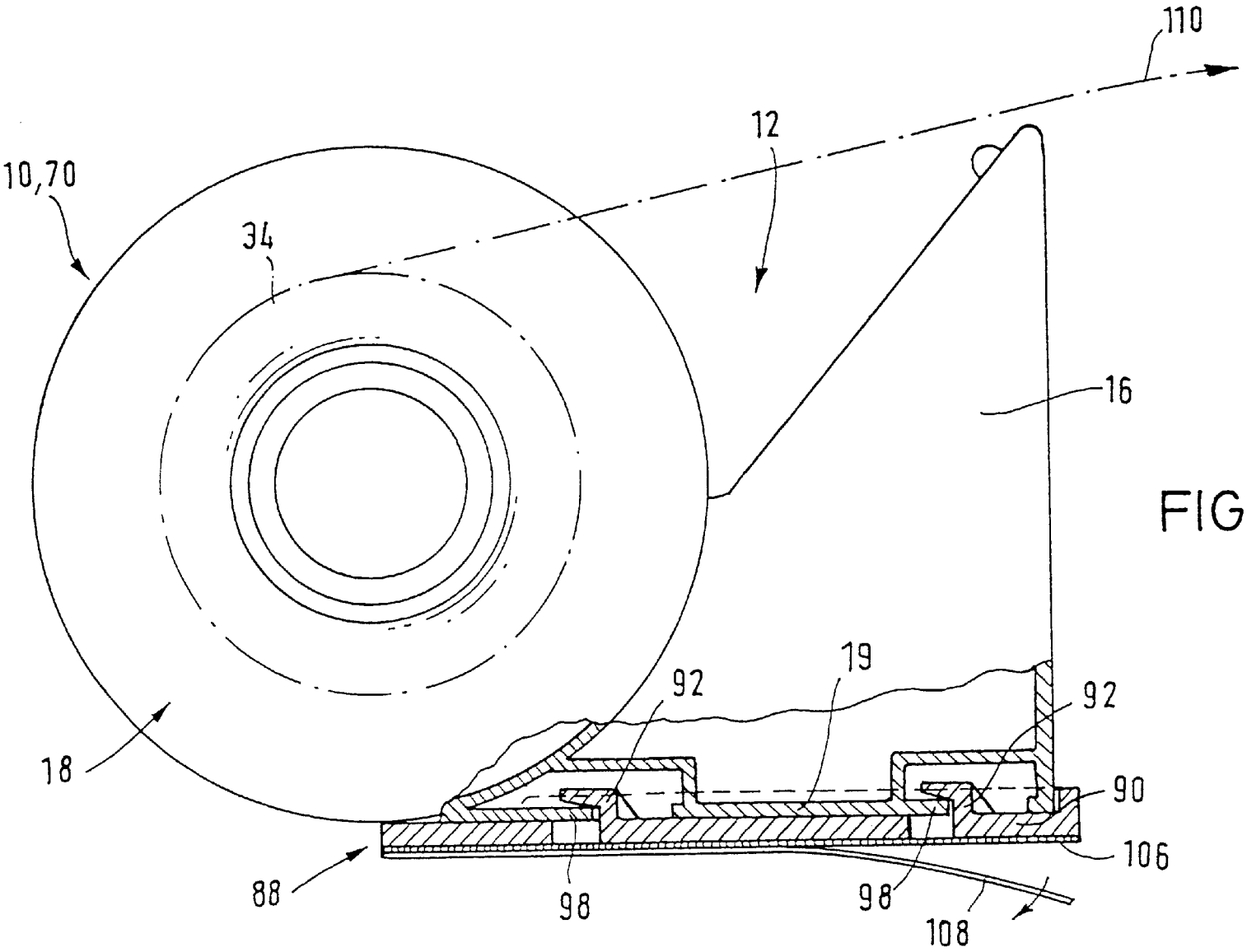
FIG. 7 shows the tape dispenser according to FIG. 1 retained by a retainer with a self-adhesive bottom side.

Referring to FIGS. 6 and 7, a wall and table holding means for the adhesive tape dispensers 10 and 70, respectively, is to be described hereinafter. FIG. 6 shows the holding means 88 fastened by screws at a vertical surface or wall 86, which holding means comprises a holding body in the form of a holding plate 90 which is fastened by screws to the wall 86. The holding plate 90 is provided with two protruding hook-shaped holding elements (holding-down devices) 92 arranged one behind the other which extend along the width of the holding plate 90 which is as wide as the housing 12 of the adhesive tape dispenser 10,70, apart from a continuous edge 94. In the bottom wall 19 of the housing section 16, which is, among others, defined by the edge 20 of the housing section 16, two recesses 96 are formed the distance between which is the same as between the hook-shaped holding-down elements 92 of the holding plate 90. The size of the apertures 96 is selected such that the housing 12 can be placed upon the holding plate 90, the holding-down elements 92 extending through the apertures 96. After the housing 12 of the adhesive tape dispenser 10 or 70, respectively, has been placed onto the holding plate 90, it is moved against the holding-down elements 92, the latter engaging behind edges on holding projections 98 of the bottom wall 19, which edges partially define the apertures 96. Due to a corresponding configuration as inclined surfaces of the surfaces 100 of the holding-down elements 92, which surfaces abut the edges 98, the housing 12 of the adhesive tape dispenser 10,70 is held in a clamping connection at the holding plate 90 when being moved in the direction of the arrows 102 of FIG. 6. By establishing a seal of the interior of the housing section 16 by the wall sections indicated at 104 in FIG. 6 within the housing section 16, it is prevented that the housing section 16 is soiled by particles entering into the interior through the apertures 96.

Instead of fastening the holding means 88 by means of screws according to FIG. 6, it is also possible to fasten the holding means 88 according to FIG. 7 by sticking it to a surface. The bottom side of the holding plate 90 is provided with an adhesive layer 106 to which a protective film 108, which can be pulled off, adheres. Further on, FIG. 7 graphically shows, in contrast to FIG. 6, the state in which the adhesive tape dispenser 10,70 is held when being mounted to the holding means 88. As can be seen in FIG. 7, the housing 12 is stressed such when being subject to forces occurring when adhesive tape is pulled off in the direction of arrow 110 that the edges on the holding projections 98 that partially define the apertures 96 are urged against the holding-down elements 92, thus excluding the possibility of a release of the housing 12 out of the holding means 88 when drawing off adhesive tape.

What is claimed is:

1. An adhesive tape dispenser comprising:

a housing comprising;

a housing body portion including a generally cylindrical part having an axis and comprising wall means defining a socket adapted to receive the roll of tape including a peripheral wall adapted to encircle the roll of tape and defining a tape roll aperture through which a roll of tape may be inserted into the socket, said peripheral wall having a tape passage for tape being pulled from said roll of tape in the housing body, said housing body further including a generally triangular part defined by walls having outer major surfaces disposed parallel with said axis, said part being generally triangular when viewed in a plane at a right angle to said axis, said walls defining said generally triangular part comprising a first straight wall extending as a tangent to said peripheral wall a second straight wall disposed at a right angle to said first straight wall at the end of said first straight wall opposite said peripheral wall, said second straight wall having a length longer than the diameter of said generally cylindrical part, and a third straight wall extending from the end of said second straight wall opposite said first straight wall to said peripheral wall so that said straight walls are disposed in the shape of a triangle, said tape passage being disposed adjacent said third straight wall and said generally triangular part including a tape cutting edge and a member adapted to have an end of the adhesive tape adhered thereto adjacent the intersection of said second and third straight walls;

a cover adapted for closing the tape roll aperture so that said cover and said cylindrical housing body close said socket except for said tape passage;

a supporting hub in said housing body portion for rotatably supporting said roll of tape;

said cover including a stud; and said stud and said supporting hub comprising cooperating means for securing said cover to said housing body by twisting said cover relative to said housing body;

said dispenser further including holding means for releasably attaching said housing to a support surface, said holding means comprising:

spaced holding projections having edges along said outer surface of said first straight wall partially defining openings through and spaced along said first straight wall, said edges being generally parallel to said axis and being aligned in a direction perpendicular to said axis, and a mounting member comprising a holding plate having opposite front and rear major surfaces, which holding plate can be fastened to said support surface with said rear major surface along said support surface, and two spaced hook-shaped holding elements projecting from the front major surface of said holding plate, said holding elements having proximal ends attached to said holding plate and distal ends opposite said holding plate and being adapted to be received in said spaced openings along said first straight wall with said front major surface of the holding plate against the outer surface of said first straight wall of the dispenser, and having inclined surfaces adapted for releasably engaging said edges of said holding projections of said housing by movement of said housing relative to said mounting member in a direction parallel to said first straight wall, said holding projections substantially pointing to the pull-off direction of said tape from said roll of tape, and said inclined surfaces being generally planar, extending from said proximal to said distal ends of said holding elements, and being oriented to cause forces occurring when tape is pulled from said roll of tape to bias said inclined surfaces into engagement with said edges of said holding projections and thereby said outer surface of said first straight wall into surface to surface engagement against said front major surface of said holding plate.

2. The tape dispenser of claim 1, characterized in that said stud is located in the supporting hub of said housing body when the cover is positioned on the housing body to close the tape roll aperture, and in that said stud has an outer surface, and said supporting hub has an inner surface, with said outer and inner surfaces comprising cooperating means for securing said cover to said housing body by twisting said cover relative to said housing body when said stud is placed in said supporting hub.

3. The tape dispenser of claim 2, characterized in that said stud of said cover comprises at least one radially projecting outer projection defining at least a portion of said outer surface, and said hub has a radial inner projection defining at least a portion of said inner surface, said radially projecting outer projection being moved behind said radial inner projection by twisting said cover relative to said housing body.

4. The tape dispenser of claim 3, characterized in that said inner surface of said radial inner projection is inclined axially of said hub away from said tape roll aperture.

5. The tape dispenser of claim 4, characterized in that said inner projection has a catch recess defining at least a portion of said inner surface and adapted to receive said at least one outer projection of said stud.

6. The tape dispenser of (one of the claims) claim 3, characterized in that said inner projection comprises stop means for limiting the twisting movement of said cover relative to said body member when said outer projection of said stud is engaged behind said inner projection.

7. The tape dispenser of claim 3, characterized in that said stud comprises four outer projections spaced from each other by 90° and said supporting hub comprises two diametrically opposing inner projections.

8. The tape dispenser of claim 1, characterized in that said cooperating means comprises said stud having an outer thread and said supporting hub having an inner thread engageable by said outer thread of said stud.

9. The tape dispenser of claim 1, characterized in that said housing body comprises an aperture edge defining said tape roll aperture, and in that said cover only abuts said aperture edge when said housing body and cover are closed.

10. The tape dispenser of claim 1, characterized in that said cover has a peripheral edge comprising means for facilitating gripping of the cover when the cover is twisted relative to the body member.

11. The tape dispenser of claim 1, characterized in that said cover has an annular groove, said housing body has an aperture edge defining and encompassing said tape roll aperture, and said aperture edge is located in said annular groove when said housing body and cover are closed.

12. The tape dispenser of claim 1, characterized in that said cover is made of a transparent material.

13. The tape dispenser of claim 1, characterized in that said cover has an inner surface facing said housing body, and said housing body has an inner surface facing said cover, and said cover and housing body comprise spacer means for restricting movement of said roll of tape to within a predetermined minimum distance from said inner surfaces.

14. The tape dispenser of claim 11, characterized in that said supporting hub of said housing body has, when viewed in longitudinal section, a concave peripheral surface for centering said roll of tape along said supporting hub.

15. The tape dispenser of claim 1 characterized in that said cover comprises a cover portion covering said tape roll aperture of said housing body, which cover portion comprises a supporting hub section carrying said stud, which supporting hub section is even with said supporting hub of said housing body in the closed state thereof and which, together with said supporting hub, rotatably supports said roll of tape.

16. The tape dispenser of claim 15, characterized in that said supporting hub section of said cover portion and said supporting hub of said housing body are both tapered towards their adjacent ends.

* * * * *

UNITED STATES PATENT AND TRADEMARK OFFICE

CERTIFICATE OF CORRECTION

PATENT NO. : 6,145,722
DATED : November 14, 2000
INVENTOR(S) : Behrens et al.

It is certified that error appears in the above-identified patent and that said Letters Patent is hereby corrected as shown below:

Column 10,
Line 1, "dispenser of (one of the claims) claim 3," should read -- dispenser of claim 3, --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*